US010000866B2

(12) United States Patent
Flad

(10) Patent No.: US 10,000,866 B2
(45) Date of Patent: Jun. 19, 2018

(54) DRAFTING DEVICE FOR SPINNING-KNITTING MACHINES

(71) Applicant: SIPRA PATENTENTWICKLUNGS—UND BELTEILIGUNGSGESELLSCHAFT MBH, Albstadt (DE)

(72) Inventor: Axel Flad, Burladingen (DE)

(73) Assignee: SIPRA Patententwicklungs—und Belteiligungsgesellschaft mbH, Albstadt (DE)

( * ) Notice: Subject to any disclaimer, the term of this patent is extended or adjusted under 35 U.S.C. 154(b) by 235 days.

(21) Appl. No.: 14/889,964

(22) PCT Filed: Apr. 11, 2014

(86) PCT No.: PCT/EP2014/057362
§ 371 (c)(1),
(2) Date: Nov. 9, 2015

(87) PCT Pub. No.: WO2014/183935
PCT Pub. Date: Nov. 20, 2014

(65) Prior Publication Data

US 2016/0168762 A1 Jun. 16, 2016

(30) Foreign Application Priority Data

May 15, 2013 (DE) ..... 10 2013 104 993

(51) Int. Cl.
*D01H 1/115* (2006.01)
*D04B 9/14* (2006.01)
*D04B 9/00* (2006.01)

(52) U.S. Cl.
CPC ..... *D01H 1/115* (2013.01); *D04B 9/00* (2013.01); *D04B 9/14* (2013.01)

(58) Field of Classification Search
CPC ..... D01H 1/115; D04H 4/02; D04B 9/14
See application file for complete search history.

(56) References Cited

U.S. PATENT DOCUMENTS 4,942,731 A * 7/1990 Morihashi ..... D02G 3/281 57/315
5,107,671 A * 4/1992 Morihashi ..... D01H 1/115 57/328
5,142,857 A * 9/1992 Matsui ..... B65H 67/064 242/474

(Continued)

FOREIGN PATENT DOCUMENTS

DE 4032117 4/1992
DE 19500036 7/1996
DE 102006062363 6/2008

(Continued)

*Primary Examiner* — Shaun R Hurley
(74) *Attorney, Agent, or Firm* — Collard & Roe, P.C.

(57) ABSTRACT

A drafting device for spinning-knitting machines includes a drafting arrangement with which at least two roving yarns can be drawn parallel to form fiber strands and at an outlet of which a nozzle unit with twist nozzles arranged parallel to one another for each of the drawn fiber strands is arranged. Between the inlets of the twist nozzles, the nozzle unit is provided with a respective plate-shaped separator projection that extends up to a withdrawal roller pair of the drafting arrangement.

5 Claims, 2 Drawing Sheets

(56) References Cited

U.S. PATENT DOCUMENTS 5,170,619 A * 12/1992 Noda ..... D01H 1/115
57/328

FOREIGN PATENT DOCUMENTS

| | | |
|---|---|---|
| TW | 200848562 | 12/2008 |
| TW | 200848564 | 12/2008 |
| WO | WO2009026734 | 3/2009 |

* cited by examiner

DRAFTING DEVICE FOR SPINNING-KNITTING MACHINES

CROSS-REFERENCE TO A RELATED APPLICATION

The invention described and claimed hereinbelow is a National Stage Application of PCT/EP2014/057362, filed Apr. 11, 2014 (the PCT application), under 35 USC § 371. The PCT application claims priority from German Patent Application DE 10 2013 104 993.1, filed on May 15, 2013. The German priority application and the PCT application are incorporated herein by reference and provide the basis for a claim of priority of invention.

BACKGROUND OF THE INVENTION

The invention relates to a drafting device for spinning-knitting machines with a drafting arrangement, with which at least two roving yarns can be drawn parallel to form fibre strands and at the outlet of which a nozzle unit with twist nozzles arranged parallel to one another for each of the drawn fibre strands is arranged.

Such drafting devices are known from document WO 2009/026734 A1, for example. They serve to feed fibre strands produced from a roving yarn with substantially parallel oriented fibres to the knitting needles of a knitting machine. The knitted fabrics produced from such fibre strands have a clearly softer surface compared to the surface of knitted fabrics produced from conventional yarns. Since the space conditions particularly on circular knitting machines are confined, at least two fibre strands are drawn parallel to one another with the drafting devices, are provided with a false twist by means of twist nozzles and then fed to knitting needles of adjacent knitting points. For this, the nozzle unit connected to a vacuum unit has a twist nozzle for each of the fibre strands generated by the drafting arrangement.

In the known drafting units malfunctions often occur when fibres of a fibre strand are also drawn in by the adjacent nozzle. This problem mainly arises when the nozzle associated with the fibre strand is blocked.

A ring spinner is known from DE 195 00 036 A1, which has a continuous perforated roller as bottom roller and two top rollers interacting with the perforated roller for parallel drawing of two fibre strands. In the event of a thread break both fibre strands are aspirated off by a common suction tube. An unfavourable influence on the two yarns formed in parallel as a result of transverse fibres of the respective other yarn is prevented by a separator plate, which is arranged at the mouth of the suction tube and extends up to the location of the perforated roller, at which the two formed yarns are removed from the perforated roller. However, the yarns are not transported further by the suction tube here, but are pulled free from the perforated roller. The suction tube merely serves to remove the yarns in the event of a thread break, wherein a suction tube is provided for both yarns.

SUMMARY OF THE INVENTION

The object forming the basis of the present invention is to provide a drafting device for knitting machines, which prevents malfunctions of the nozzle unit as a result of transverse fibres between the fibre strands.

The object is achieved by a drafting device for spinning-knitting machines with a drafting arrangement, with which at least two roving yarns can be drawn parallel to form fibre strands and at the outlet of which a nozzle unit with twist nozzles arranged parallel to one another for each of the drawn fibre strands is arranged, which is characterised in that between the inlets of the twist nozzles the nozzle unit is provided with a respective plate-shaped separator projection, which extends up to a withdrawal roller pair of the drafting arrangement.

In the drafting device according to the invention yarn faults resulting from transverse fibres of the fibre strands passing into the wrong twist nozzle can be prevented by the separator projection between the inlets of the twist nozzle on the nozzle unit. If one of the nozzles becomes blocked, the fibre strand associated with it cannot be aspirated by the adjacent nozzle and also block this nozzle or cause thickening of the yarn produced with this nozzle.

If the separator projection is oriented perpendicular to the axes of the withdrawal roller pair, symmetrical conditions for fibre strand guidance result on both sides of the separator projection.

To increase the effectiveness of the separator projection, this can have a point, which projects into the recess between the rollers of the withdrawal roller pair. In this way, the separator projection can be moved close to the two rollers of the withdrawal roller pair, which improves its separating action. A further optimisation of the separation function of the projection can be achieved in this case in that, at least in sections, the flanks of the point run parallel to the cylindrical surface of the rollers of the withdrawal roller pair. As a result of this measure the separator projection is spaced at the same distance from both rollers of the withdrawal roller pair, and this distance can, moreover, be kept very small. Therefore, the suction action of the two nozzles separated from one another by the separator projection cannot extend to the respective other fibre strand exiting between the two rollers of the withdrawal roller pair.

The at least one separator projection can preferably be arranged on a housing for the twist nozzles. It can be fastened there and adjusted in relation to the withdrawal roller pair of the drafting arrangement without problem. It can also be configured in one piece with the housing for the twist nozzles. In a preferred configuration, however, the separator projection is a sheet metal part, which can be produced by stamping, for example, and arranged in the centre between two nozzles.

BRIEF DESCRIPTION OF THE DRAWINGS

A preferred exemplary embodiment of a drafting device is described in more detail with reference to the drawing.

DETAILED DESCRIPTION OF THE INVENTION

Figure 1:
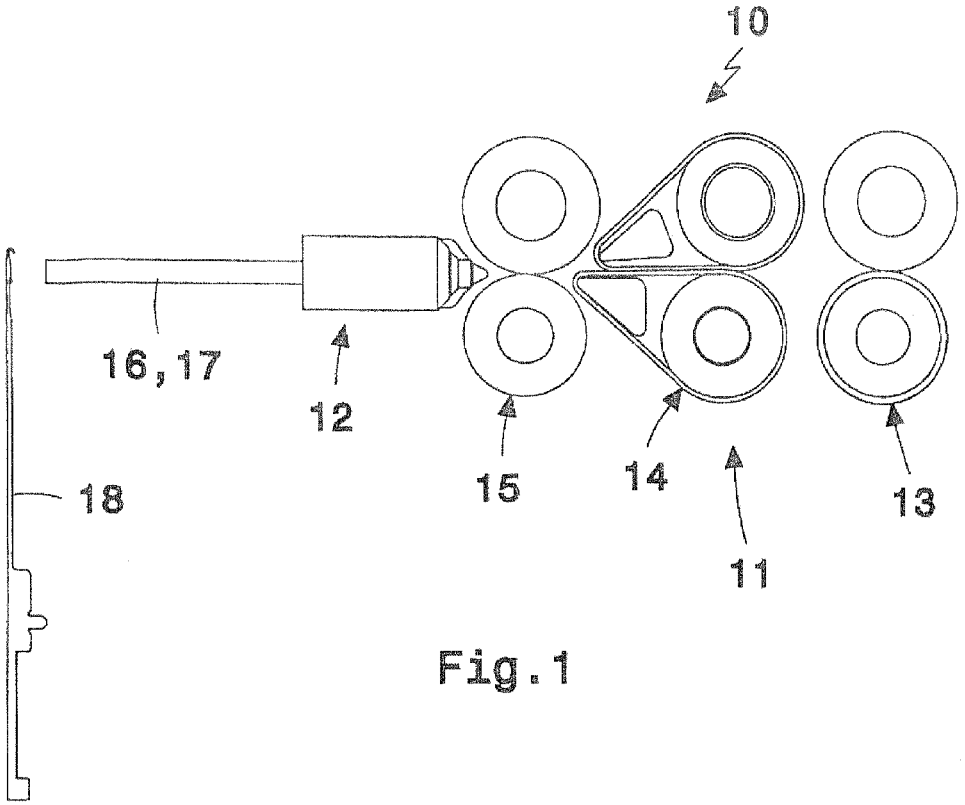
FIG. 1 is a schematic side view of a drafting device and a needle of a knitting machine.

According to FIG. 1 the drafting device 10 has a drafting arrangement 11 and also a nozzle unit 12. The drafting arrangement 11 in the represented example is a threecylinder drafting arrangement with a feed roller pair 13, a double apron roller pair 14 and also a withdrawal roller pair 15. Between the upper and lower rollers of the roller pairs 13, 14 and 15 two fibre strands (not shown) are drawn parallel and fed to the nozzle unit 12. In the nozzle unit 12 the fibre strands are provided with a false twist and fed via tubes 16, 17 to knitting needles 18 of a knitting machine (not shown further).

Figure 2:
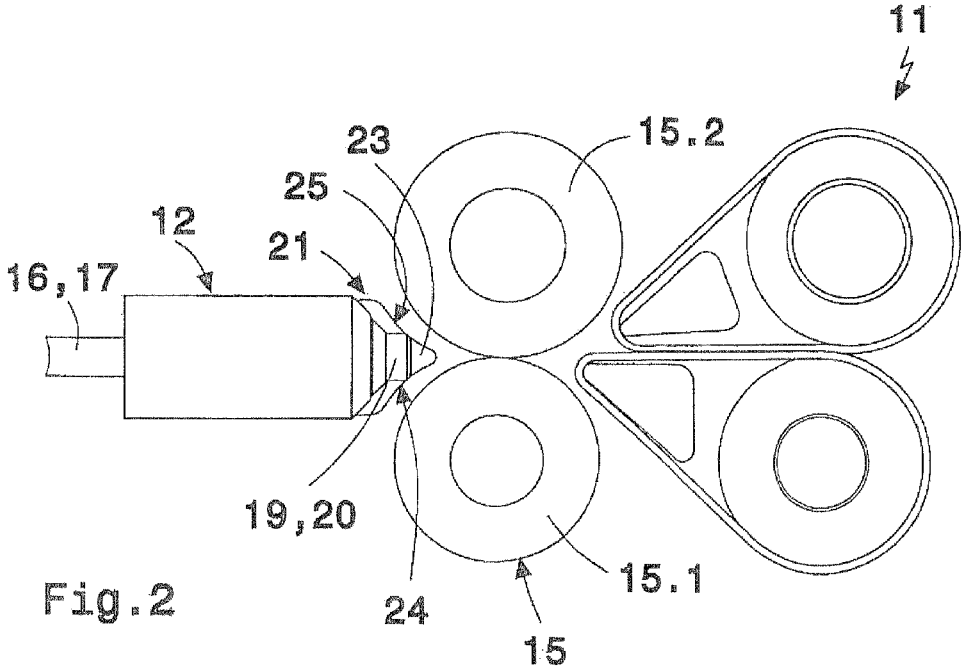
FIG. 2 is an enlarged side view of the drafting device from FIG. 1.
Figure 3:
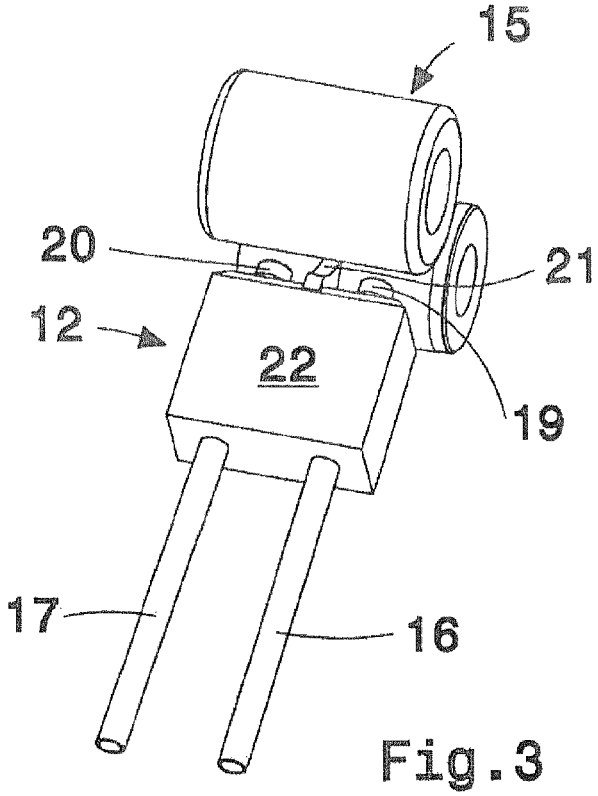
FIG. 3 is a perspective view from above onto the nozzle unit and the withdrawal roller pair of the drafting device from FIG. 1.
Figure 4:
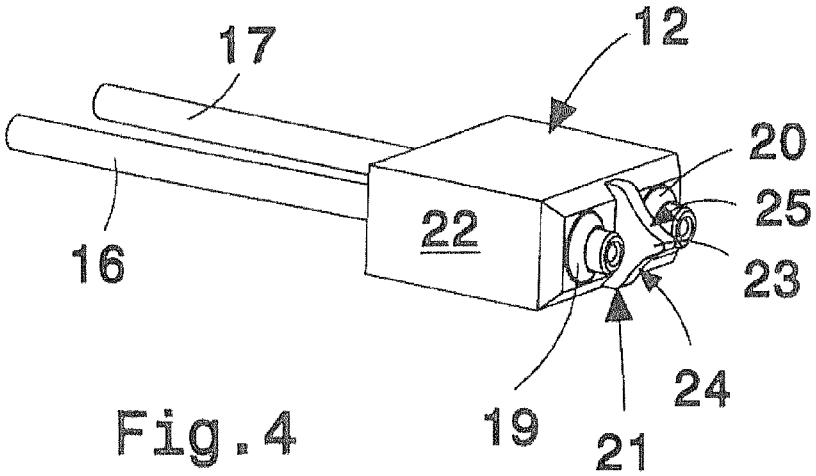
FIG. 4 is a perspective detail view of the nozzle unit of the drafting device from FIG. 1.

As can better be seen from FIGS. 3 and 4, the nozzle unit has two twist nozzles 19, 20, between which a separator projection 21 is arranged on a housing 22 for the twist nozzles 19, 20. FIG. 2 in particular illustrates that the separator projection 21 has a point 23, the flanks 24, 25 of which are curved in accordance with the cylindrical surface of the two rollers 15.1 and 15.2 of the withdrawal roller pair 15. This results in a uniform distance between the separator projection 21 and the rollers 15.1 and 15.2. The separator projection 21 can thus develop its action of separating the transport paths of the two fibre strands in an optimum manner. The fibre strands cannot be aspirated by the respective adjacent twist nozzle 19, 20.

As illustrated in FIGS. 3 and 4, the separator projection 21 is plate-shaped in configuration and is arranged in the centre between the twist nozzles 19, 20 on the housing 22. It can preferably be a sheet metal part, which can be fastened to the housing 22 by gluing, welding or soldering.

What is claimed is:

1. A drafting device for spinning-knitting machines, comprising:

a drafting arrangement for drawing at least two roving yarns in parallel to form fiber strands;

a nozzle unit with twist nozzles arranged parallel to one another for each of the drawn fiber strands arranged at an outlet of the drafting arrangement;

wherein the nozzle unit is provided with a plate-shaped separator projection between inlets of the twist nozzles that extends up to a withdrawal roller pair of the drafting arrangement, and wherein the separator projection is arranged on a housing for the twist nozzles in the center between adjacent twist nozzles.

2. The drafting device according to claim 1, wherein the separator projection is oriented perpendicular to axes of the withdrawal roller pair.

3. The drafting device according to claim 1, wherein the separator projection has a point that projects into a recess between the rollers of the withdrawal roller pair.

4. The drafting device according to claim 3, wherein the point has flanks that run parallel to a cylindrical surface of the rollers of the withdrawal roller pair, at least in sections.

5. The drafting device according to claim 1, wherein the separator projection is fabricated from a metal sheet.

* * * * *